US005369915A

United States Patent [19]

Kanai

[11] Patent Number: 5,369,915

[45] Date of Patent: Dec. 6, 1994

[54] GRINDING APPARATUS FOR GRINDING END FACES OF ARMATURE

[75] Inventor: Kanji Kanai, Ashikaga, Japan

[73] Assignee: Mitsuba Electric Mfg. Co. Ltd., Kiryu, Japan

[21] Appl. No.: 990,128

[22] Filed: Dec. 14, 1992

[30] Foreign Application Priority Data

Dec. 19, 1991 [JP] Japan ..... 3-337286

[51] Int. Cl.[5] ..... B24B 7/17

[52] U.S. Cl. ..... 451/190; 451/132; 451/150

[58] Field of Search ..... 51/80 A, 80 R, 215 AR, 51/215 HM, 215 UE, 38, 42, 34 C, 34 D, 40, 51, 103 TF, 98 SP, 111 R, 112

[56] References Cited

U.S. PATENT DOCUMENTS

| | | | |
|---|---|---|---|
| 2,109,450 | 3/1938 | Schlayer et al. | 51/80 R |
| 2,242,801 | 5/1941 | Richardson | 51/80 A |
| 2,383,927 | 8/1945 | Carlson | 51/80 A |
| 3,425,169 | 2/1969 | Dunn | 51/215 HM |
| 3,503,161 | 3/1970 | Long | 51/80 R |
| 3,818,639 | 6/1974 | Dunn | 51/112 |
| 3,872,628 | 3/1975 | Dunn | 51/215 HM |

*Primary Examiner*—Jack W. Lavinder
*Attorney, Agent, or Firm*—Darby & Darby

[57] ABSTRACT

An apparatus is presented to automatically handle operations related to grinding simultaneously the two end faces of a core of an armature. The apparatus consists of four main sections: a charging section to charge a core at a time to a transport section; a transport section to transport the core to the grinding section, a grinding section disposed at the lowest region of the transport section to grind the two end faces simultaneously; and a discharging section to discharge the ground core for further processing. The cores are individually housed in the retaining grooves of the transport section with the core axis lying horizontally. The grinding wheels of the grinding section straddles the core, thus enabling the two end faces to be ground at the same time. The apparatus performs a series of operations related to removing of the silica film from the end faces automatically, including the maintenance of the grinding surface of the grinding wheels, thus providing a cost-effective method to replace the conventional manual grinding operations.

11 Claims, 5 Drawing Sheets

GRINDING APPARATUS FOR GRINDING END FACES OF ARMATURE

BACKGROUND OF THE INVENTION

1. Field of the Invention

The present invention relates to an automatic grinding apparatus for grinding the end faces of a cylindrical-shaped iron core, a component part of an armature, simultaneously and efficiently.

2. Background of the Invention

An iron armature core 1 (or core 1) shown in FIG. 6, a part of a rotating armature of a motor, used in such pumping devices as fuel pump motor, comprises a plurality of thin steel strips (of 0.35–1.00 mm strip thickness) are laminated to a certain core thickness T and has a plurality of slots 2 formed on the peripheral surface thereof. The strip material is usually a silicon steel to provide special electrical characteristics.

The entire core 1 is coated with an insulating material, such as an epoxy resin, for electrical insulation, then windings are installed in the slots. An armature shaft 3 is press fitted into a shaft hole formed in the axis of the core 1.

In such a case, the end faces 1*a*, 1*b* of the core 1, made by laminating silicon steel strips, are covered with a silica film, whose thickness is of the order of several micrometers.

Because this silica film is poorly bonded to the base steel, an epoxy coating applied on top of such a film could easily peel off from the core 1 to expose the base steel, thus producing a defective core which could present shorting problems. For this reason, the practice is to manually remove such films from both end faces 1*a*, 1*b* of the silicon steel iron core 1.

However, such manual operation is inevitably time consuming and inefficient, and contributed to rising prices of armature components.

Therefore, there was a need for automated apparatus for removing the silica films from both end faces 1*a*, 1*b* of a core 1 efficiently and cost effectively.

SUMMARY OF THE INVENTION

The objective of the present invention is to present an apparatus for efficiently and mechanically removing films from both end faces of an iron core for use in armatures.

A grinding apparatus for simultaneously grinding end faces of a cylindrical iron core for use in armatures comprising:

(a) a transport section provided with a plurality of retaining grooves, each groove housing a core with the core axis oriented horizontally, and moving in a given direction;

(b) supply section for supplying the core continuously to each retaining groove provided on the moving transport section;

(c) a grinding section disposed in the transport section for simultaneously grinding both end faces of the core housed in the retaining groove;

(d) a discharging section comprising an entry part serving as a housing for a ground core from the retaining groove to the entry part, and an exit part for discharging the ground core from the discharging section.

In the apparatus of the present invention, the silica film on the end faces of a core, housed and transported continually by the core transport section, is removed from the surfaces by the grind section by grinding the two end surfaces simultaneously. The processed cores are discharged from the exit part of the discharging section to other areas. Therefore, the grinding apparatus of the present invention provides an automated continuous series of processing operation of the core, including supplying, grinding of the two end faces and discharging of the processed cores.

DETAILED DESCRIPTIONS OF THE PREFERRED EMBODIMENTS

The apparatus for grinding the end faces of an armature core will be explained with reference to FIGS. 1 to 5.

Figure 1:
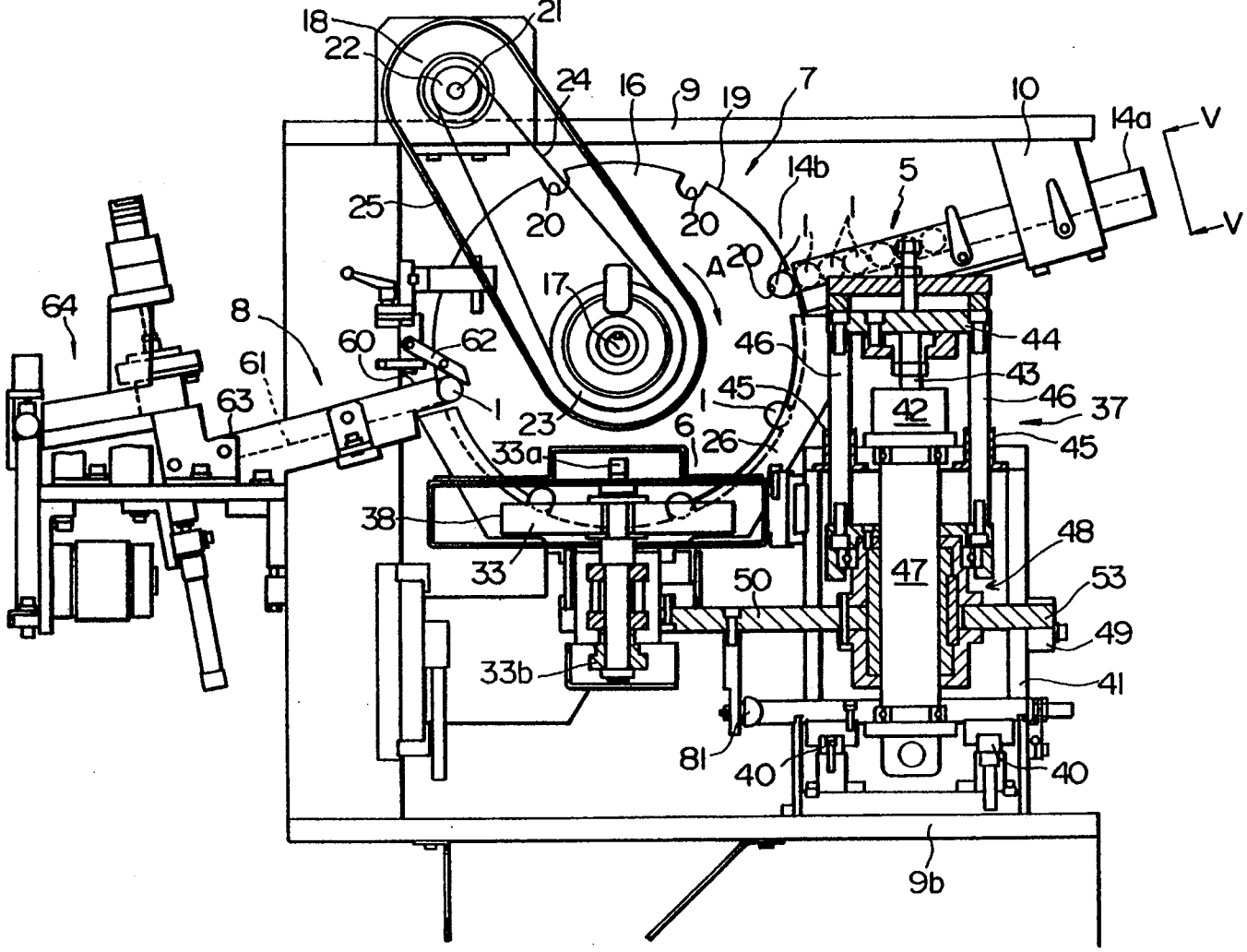
FIG. 1 is a front view of an end grinding apparatus for grinding the end faces of cores of armatures.

The apparatus shown in FIG. 1 comprises: a core supply section 5 for supplying a plurality of cores 1; a grinding section 6 for grinding both end faces 1*a*, 1*b* of the core 1; a core transport section 7 for transporting a core 1 from the core supply section 5 to the grinding section 6; and a core discharging section 8 for transporting a processed core 1 out of the grinding section 6. The core to be processed does not have a shaft 3 inserted therein.

The core supply section 5 is disposed with one end facing downward in an inclined position on the fixation part 10 which is joined to the upper frame 9 of the apparatus framing. As shown in an end view in FIG. 5, the core supply section 5 includes a U-shaped core supply duct 14 formed by side plates 11, 12 and the bottom plate 13. A proximity switch 15 is disposed above the supply duct 14.

A plurality of cores 1 forwarded from the entry end 14*a* roll down on the bottom plate 13 to the exit end 14*b* and are housed, one at a time, in the core transport section 7.

The core transport section 7 comprises a disc-shaped drum 16 and a drum rotating motor 18 which rotates the drum 16 continuously at a selected speed around the horizontal axis 17 of the drum 16.

Figure 2:
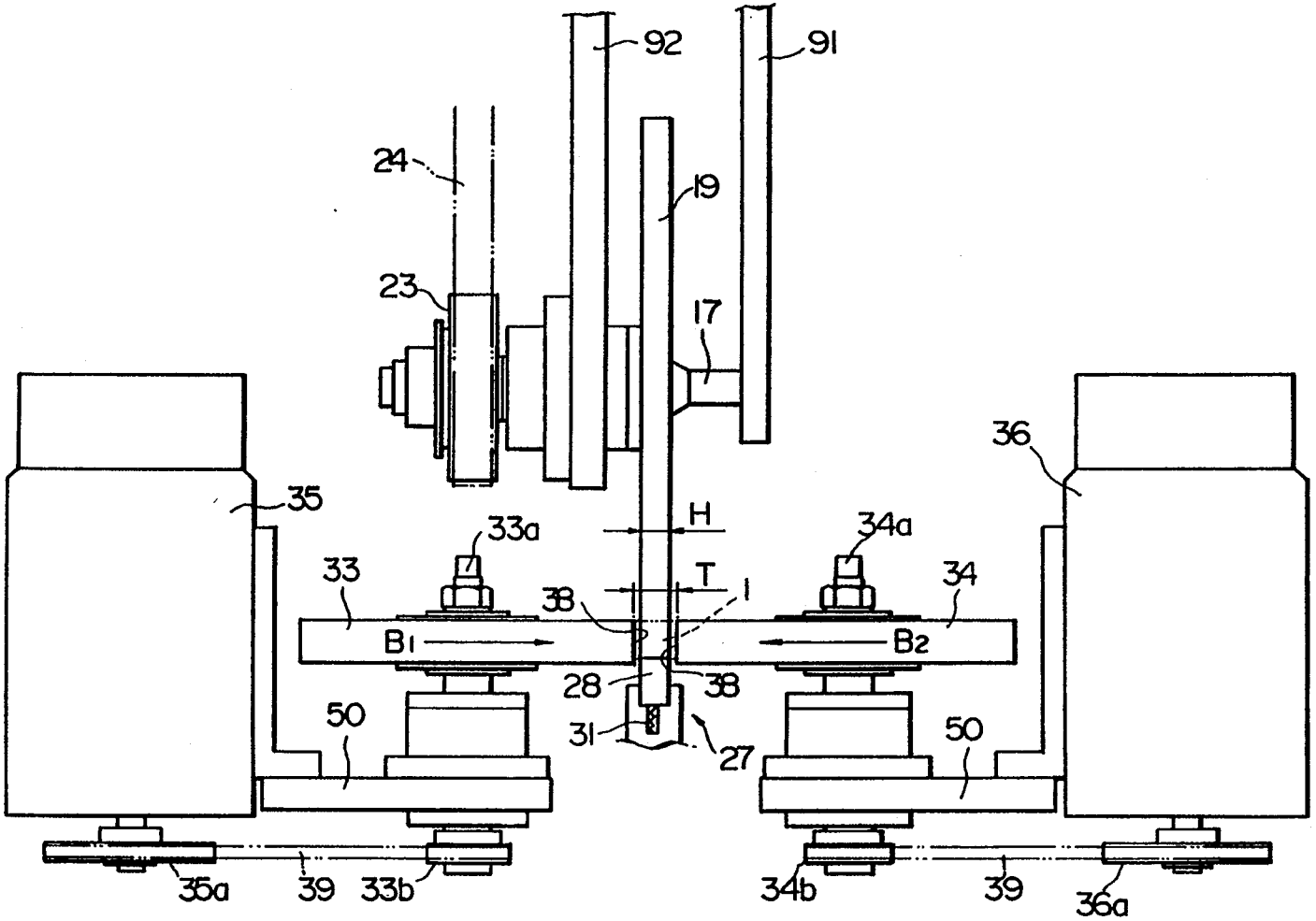
FIG. 2 is a side view of the grinding section of the apparatus shown in FIG. 1.
Figure 6:
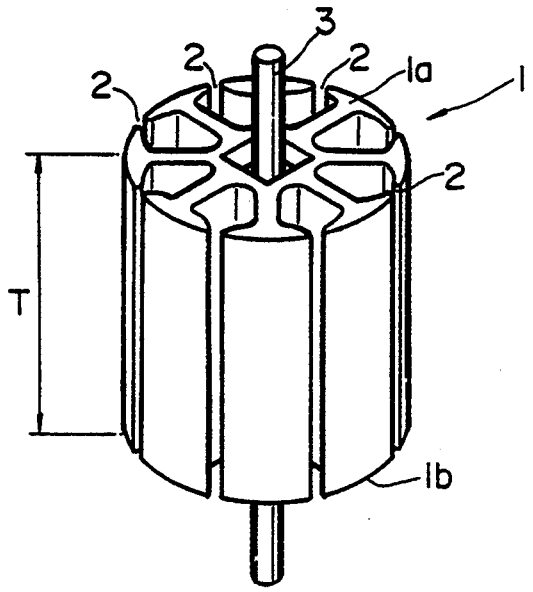
FIG. 6 is a perspective view of an armature core whose end faces are to be polished in the invented apparatus.

The drum 16 is fixed to the horizontally placed axis 17, and is freely rotatably supported by the support plates 91, 92 hanging vertically from the upper frame 9, and is disposed so that its peripheral surface 19 is adjacent to the exit end 14*b*. The peripheral surface 19 of the drum 16 is further provided with eight retaining grooves 20 spaced at a specific distance for receiving the core 1 from the exit end 14*b* one at a time. As shown in FIG. 2, the disc thickness H of the drum 16 is made to be less than the height T of the armature illustrated in FIG. 6.

The drum rotating motor 18 is fixed on an upper section of the upper frame 9, and the axial shaft 21 of the drum rotating motor 18 is provided with a pulley 22 which is operatively connected with a pulley 23 on the horizontal axis 17 of the drum 16 by means of a belt 24. Thus, by rotating the drum rotating motor 18, the rotation of the pulley 22 is transmitted to the pulley 23 of the drum 16, thereby turning the drum 16 in the direction of an arrow A continuously at a selected speed. The reference numeral 25 is a belt cover, and 26 is a guard strip to prevent dropping of the core 1 from inside the retaining groove 20.

Figure 4:
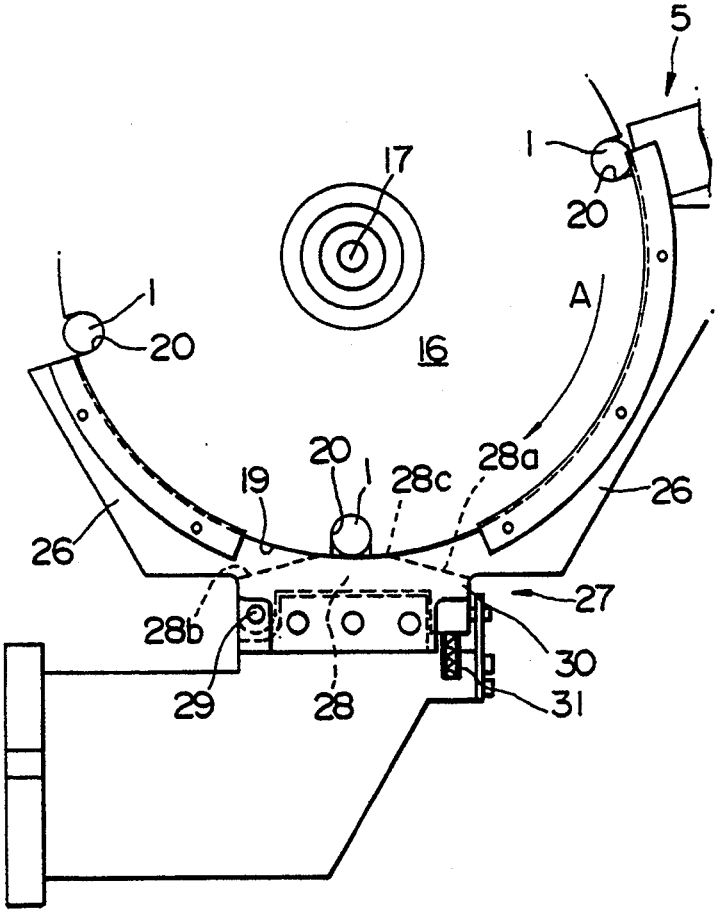
FIG. 4 is a front view of the core control section of the apparatus shown in FIG. 1.
Figure 5:
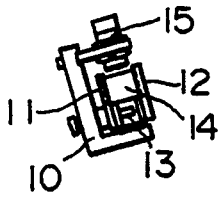
FIG. 5 is a view of the core supply section seen from the direction of the arrows V—V in FIG. 1.

As shown in FIG. 4, below the bottom of the drum 16 and opposing the peripheral surface 19 thereof is disposed a core control section 27 which stops the rolling of the core 1.

The core control section 27 is provided with a control part 28 which contacts the peripheral surface of the core 1 at the lowest position of the drum 16, and is constructed such that the one end 29 of the control part 28 has a pin connection and the opposite end 30 has a spring 31, so that the other end 29 of the control part 28 can be pushed upward toward the peripheral surface 19 of the drum 16.

When a core 1 moves in the direction of the arrow A, the core 1 first passes the sloping surface 28*a* (formed by the spring 31) of the control part 28, and when the drum 16 reaches the lowest position, the core 1 is on the control surface 28*c*. While the core 1 is on the control surface 28*c*, it is unable to rotate because of the pressing pressure exerted by the sloping surface 28*a*.

The grinding section 6 is disposed on the bottom region of the drum 16 such that the core control section 27 is disposed horizontally therebetween.

The grinding section 6 comprises, as shown in FIGS. 1 and 2, a pair of grinding wheels 33, 34 straddling the lowest section of the drum 16; wheel driving motors 35, 36 for rotating the grinding wheels 33, 34; elevator mechanism 37 for vertically moving the grinding wheels 33, 34 and the wheel driving motors 35, 36; and connecting plates 50, supported by the elevator mechanism 37, for supporting the grinding wheels 33, 34 and the wheel driving motors 35, 36.

The grinding wheels 33, 34 are disc-shaped grinding parts made of unwoven nylon fibers around the peripheral surfaces 38 (grinding surfaces), and are fixed firmly to the vertical shafts 33*a*, 34*a* freely rotatably supported by the connecting plates 50.

The grinding wheels 33, 34 at the lower end portion thereof are provided with pulleys 33*b*, 34*b* respectively, which are operatively connected with the pulleys 35*a*, 36*a* provided on the shafts of the wheel driving motors 35, 36 respectively, by means of the belts 39.

The grinding wheels 33, 34 are rotated at a selected speed in the directions of the arrows B1, B2 (in FIG. 2) by the driving motors 35, 36, thereby removing the silica from the two end faces 1*a*, 1*b* of the core 1 which has been transported to the lowest position of the drum 16 in the retaining groove 20.

The grinding wheels 33, 34 and the respective wheel driving motors 35, 36 are made to oscillate vertically by means of the elevator mechanism 37. The elevator mechanism 37 is made to move up and down repeatedly across the end faces 1*a*, 1*b* of the core 1 so as to uniformly wear the grinding surface 38 of the grinding wheels 33, 34, without causing local wear thereof.

Figure 3:
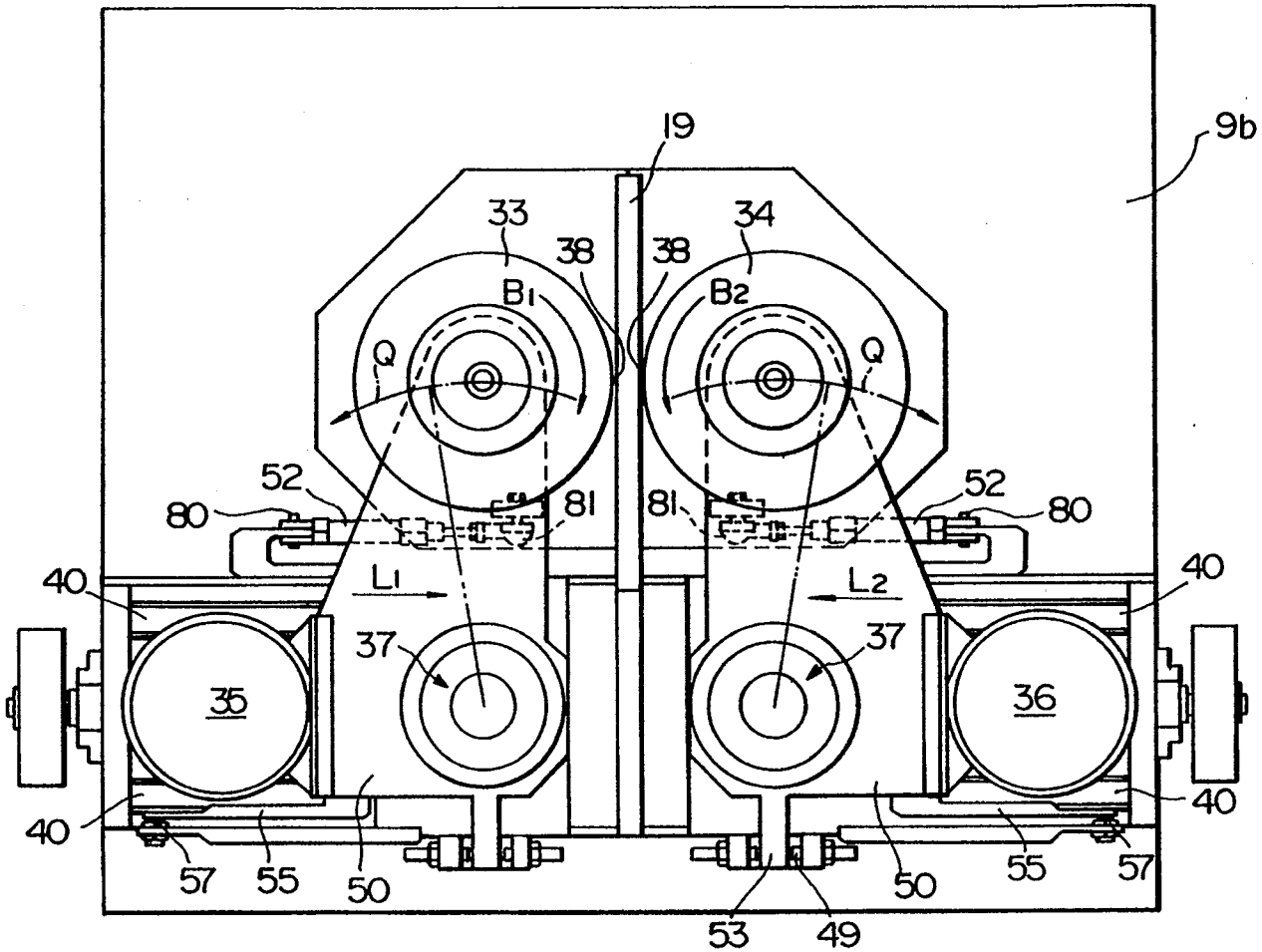
FIG. 3 is a plan view of the essential parts of the wheel contact adjustment device of the apparatus shown in FIG. 1.

The elevator mechanism 37 comprises, as shown in FIGS. 1 and 3; a bracket 41 which is supported on and movable on the guide rail 40 in the direction of the arrows L1 and L2 (left to right in FIG. 3); a cylinder 42 fixed to the upper portion of the bracket 41; an upper elevator section 44 connected to a piston rod 43 freely extendable in the vertical direction of the cylinder 42; a guide rod 46 hanging vertically from the upper elevator section 44, and is freely slidably supported by a bushing 45 installed on the bracket 41; an axial spline 47 freely rotatably supported by the bracket 41 at the lower region of the cylinder 42; a lower elevator section 48 freely rotatably attached to the lower portion of the guide rod 46, and is supported freely slidably in the vertical direction at the outside of the axial spline 47; connecting plates 50 which support the grinding wheels 33, 34 as well as provide the connection to the lower elevator section 48.

The reciprocating motion of the piston rod 43 of the cylinder 42 within a specific distance makes the upper elevator section 44, guide rod 46 and the lower elevator section 48 to move up and down (reciprocating motion) repeatedly. Because the lower elevator section 48 is connected to the connecting plate 50, the grinding wheel 33, 34 reproduces the vertical reciprocating motion.

Accordingly, the entire surface of the grinding surface 38 of the grinding wheels 33, 34 wears down uniformly without showing local wear.

Also, between the bottom surface of the connecting plate 50 and the lower portion of the bracket 41 (refer to FIG. 3) is disposed a pressing cylinder 52. The side of the pressing cylinder 52 close to the bracket 41 is connected to a pin 80 to permit vertical vibrations of the pressing cylinder 52. The side of the pressing cylinder 52 close to the connecting plate 50 is connected to the connecting plate 50 with a universal joint 81, thereby enabling the pressing cylinder 52 to follow the vertical motion of connecting plate 50 and the grinding wheels 33, 34 as well as to press the connecting plate 50 and the grinding wheels 33, 34 toward the drum 16

The connecting plate 50 rotates about the axis of the axial spline 47. However, there is a stopper device 49 on the bracket 41, and on the connecting plate 50, there is a protrusion piece 53 opposing the stopper device 49 (refer to FIG. 3) so as to restrict the movement of the connecting plate 50 thereby preventing the grinding wheel 33, 34 from touching the drum 16.

As the process of grinding the core 1 is repeated, and as the grinding wheels 33, 34 wear (decreasing the diameter of the grinding wheels 33, 34), the point of contact between the grinding wheels 33, 34 and the core 1 shifts, and the connecting plate 50 moves the center of the grinding wheels 33, 34 on a path of an arc Q whose center is at the center of the elevator mechanism 37 as illustrated in FIG. 3. This makes the protrusion piece 53 of the connecting plate 50 to touch the stopper device 49 during the grinding process. This results in limiting the movement of the connecting plate 50, leading to variations in the contact pressure between the grinding surface 38 and the core 1, leading to a loss of the grinding capability, and ultimately the grinding wheels 33, 34 stop rotating. Therefore, there is a wheel contact adjusting device for adjusting the movement of the connecting plate 50 in this embodiment.

The contact adjusting device is operated by a pulse motor (not shown), and when a control signal is send from the pulse motor, the shaft of the contact adjusting device rotates with the positive rotation direction of the pulse motor, and as shown in FIG. 3, the bracket 41 and the connecting plate 50 are moved along the guide rails 40 in the direction of the arrows L1, L2 (so as to position the connecting plate 50 closer to the drum 16).

By having the connecting plate 50 move, the grinding surface 38 of the grinding wheels 33, 34 is made to contact the side of the drum 16, thereby the connecting plate 50 rotates slightly along the arc Q shown by the line/dot line in FIG. 3.

The slight rotation of the connecting plate 50 is sensed by a contact probe 55 disposed on the connecting plate 50, and the proximity switch 57 senses the shifting position and sends out a signal to stop the pulse motor. Next, by sending a certain number of pulse signals, the pulse motor is made to rotate in the negative direction, thereby moving the connecting plate 50 back a specific amount in the opposite direction to before, so as to set the pressure of the grinding wheels 33, 34 against the end faces 1*a*, 1*b* of the core 1.

By repeating the contact adjusting device as necessary, the grinding ability of the grinding wheels 33, 34 can be maintained for a long service period.

Further, the core discharging section 8, shown in FIG. 1, is disposed on the apparatus framing such that an end 60 (core entry 60) is pointing upward. The core 1, being transported in the retaining groove 20 after the completion of the grinding operation, is moved in the direction of the arrow A and is discharged out of the retaining groove 20 into the core entry 60 by engaging with the hook 62 disposed on the core entry 60 in the discharging chute 61. The discharged core 1 rolls down the discharging chute 61 to the core discharge end 63 to be forwarded to a core storage 64.

Next, the steps of grinding the silica film off from the end faces 1*a*, 1*b* of the core 1 using the apparatus described above will be explained.

First, the drum 16 is rotated at a selected speed in one direction by means of the drum rotating motor 18. The wheel driving motor 35, 36 are operated to rotate the grinding wheels 33, 34 in the direction of the arrows B1, B2 and, at the same time, the elevator mechanism 37 is operated to begin oscillating the grinding wheels 33, 34 vertically with the drum in the position as shown in FIG. 1.

The cores 1, rolling down from the entry end 14*a* to the exit end 14*b*, are charged into the retaining groove 20 one at a time. The cores 1 in the retaining groove 20 are moved toward the bottom region of the drum 16 while being guided by the guard strip 26.

When the core 1 housed in the retaining groove 20, reaches the lowest point of the transport section 7, the core 1 is prevented from rotating by the action of the control part 28 of the core control section 27.

The two end faces 1*a*, 1*b* of the core 1 positioned on the control surface 28*c* are ground by the grinding surface 38 of the grinding wheels 33, 34 to remove the silica film therefrom. In performing such an operation, because the grinding wheels 33, 34 are oscillated vertically by means of the elevator mechanism 37, the grinding surface 38 wears down evenly thus preventing distortions of the grinding surface.

When the grinding of the two end faces 1*a*, 1*b* is completed, the core 1 is moved by the retaining groove 20 from the control surface 28*c* above and over the other inclined surface 28*b* of the core control section 27 to head towards the core discharging section 8 while being bounded by the guard strip 26.

The core 1 moved to the core entry 60 of the core discharging section 8 engages with a hook 62, and is withdrawn into the core entry 60. The core 1 then rolls down the discharging chute 61 to reach the discharge end 63, and is forwarded to a storage.

By repeating the above process for other cores housed in the retaining grooves 20, end surface grinding operation is performed for a plurality of cores 1.

For example, when 100 cores 1 are to be processed continuously, the grinding surface 38 of the grinding wheels 33, 34 experiences a certain amount of wear, and the grinding efficiency suffers. In such a case, the above described process of wheel contact adjustment mechanism is utilized to keep the grinding wheels 33, 34 always in the optimum grinding condition and to prolong the service life of the grinding wheels 33, 34.

To summarize the feature of the end surface grinding apparatus of the present invention, the apparatus makes it possible to carry out an automated grinding operation of the cores 1 continuously and efficiently, by comprising: a drum 16 having a plurality of retaining grooves 20 for housing a core 1 in each of the retaining grooves 20, and rotating the drum 16 about a horizontal axis 17 in the direction of arrow A; a grinding section 6, having a pair of grinding wheels 33, 34 straddling the drum 16, which is being oscillated in a vertical direction; a core supply section 5 which supplies a core to each of the plurality of retaining grooves 20 of the drum 16; and core discharging section 8. Such an apparatus performs grinding of the two end faces 1*a*, 1*b* of the core 1 automatically and efficiently, by having the rotating drum 16 delivering the core 1 housed in the retaining grooves 20 to the grinding section 6, one at a time, to grind both surfaces 1*a*, 1*b* simultaneously and efficiently to remove the silica film therefrom. The processed core 1 is moved to the core discharging section 8, and is rolled into the discharge chute 61 to be forwarded to a storage. The invented apparatus, compared with the manual operation of the conventional method, enables the grinding operation to be performed cost effectively, leading to significant savings in operating costs.

Further aspect of the invented apparatus is that the wheel contact adjustments provided to the grinding wheels 33, 34 is effective in prolonging the service life of the grinding wheels 33, 34, thereby enabling the apparatus to carry out the grinding operation stably and with long service life.

Further aspect of the invented apparatus is that the grinding wheels 33, 34 are constantly being maintained in a condition to promote even wear of the grinding surface 38 by providing an oscillating elevator mechanism 37.

What is claimed is:

1. A grinding apparatus for simultaneously grinding end faces of a cylindrical iron core, said cylindrical iron core having an axis and two end faces, said cylindrical iron core being for use in armatures, said grinding apparatus comprising:

(a) a transport section comprising a disc-shaped drum and a driving means for rotating said drum, said disc-shaped drum having an axle of rotation and a plurality of retaining grooves, each retaining groove being formed at a specific spacing on a peripheral surface of said disc-shaped drum and being formed to accommodate one of a plurality of cylindrical iron cores therein so that the accommodated core may be transported by the drum, said axle of said disc-shaped drum being oriented horizontally, said retaining groove accommodating said cylindrical iron core such that said axis of said cylindrical iron core is oriented horizontally while positioned within said retaining groove;

(b) a supply section for supplying said cylindrical iron cores continuously to said retaining grooves of said transport section;

(c) a grinding section disposed at said transport section for simultaneously grinding both end faces of said accommodated core in said retaining groove so that the core becomes ground;

said grinding section having a control section for stopping the rotation of said cylindrical iron core during grinding of said end faces of said cylindrical iron core, said core control section being provided with a control part which is arranged to be pushed toward the peripheral surface of said drum and into contact with the cylindrical iron core being transported by said drum so as to stop the rotation of said cylindrical iron core, said grinding section comprising a pair of grinding wheels and a wheel driving means for rotating each of said pair of grinding wheels, each of said grinding wheels having an axle of rotation, said grinding wheels being disposed on a side region of said transport section such that a grinding surface of one of said pair of wheels touches one end face of said core housed in said retaining groove, while the grinding surface of the other said pair of wheels touches the other end face of said accommodated core in said retaining groove, so as to straddle said transport section said axle of each said grinding wheel being vertical, said grinding section being provided with a reciprocating means for vertically reciprocating said pair of grinding wheels; and (d) a discharging section comprising an entry part for guiding the cylindrical iron core from said retaining groove into said discharging section, and an exit part for discharging said cylindrical iron core from said discharging section.

2. An apparatus as in claim 1, wherein said driving means includes a first pulley operatively connected to said axle of said disc-shaped drum, a second pulley operatively connected to a motor shaft, and a belt operatively connecting said first pulley and said second pulley.

3. An apparatus as in claim 1, wherein said disc-shaped drum has a thickness not more than a length of said core in the axial direction.

4. An apparatus as in claim 1, wherein said wheel driving means comprises:

a pair of first pulleys operatively connected to said axle of each of said grinding wheels;

a pair of second pulleys operatively connected to said wheel driving means, and a pair of belts operatively connecting said first pulleys with said second pulleys.

5. An apparatus as in claim 1, wherein said grinding wheels make contact with said core being transported by said drum, the contact giving rise to a contact pressure, each of said grinding wheels being provided with a wheel contact adjustment means for finely adjusting the contact pressure of said grinding wheels against said core.

6. An apparatus as in claim 5, wherein said wheel contact adjustment means is provided with a connecting member which supports said grinding wheel, said connecting member being freely rotatably attached to a bracket of said reciprocating means, said connecting member being pushed by a pressing means so as to cause the contact pressure.

7. An apparatus as in claim 6, wherein said connecting member is provided with a stopper device which restricts the rotation of said connecting member within narrow limits thereby preventing said grinding wheel from touching said drum.

8. An apparatus as claimed in claim 1, wherein said grinding surface of said grinding wheels comprises unwoven nylon fibers.

9. An apparatus as claimed in claim 1, wherein said supply section comprises a U-shaped discharge means disposed in an inclined position so as to enable said core to roll down from said entry part towards said exit part.

10. An apparatus as in claim 1, wherein said transport section has guard strips to prevent dropping of said cylindrical iron cores from inside said retaining grooves, said guard strips being provided between said supply section and said control part of said control section and between said discharging section and said control part of said control section.

11. An apparatus as in claim 1, wherein said grinding surfaces are made of unwoven nylon fibers.

* * * * *

UNITED STATES PATENT AND TRADEMARK OFFICE

CERTIFICATE OF CORRECTION

PATENT NO. : 5,369,915

DATED : December 6, 1994

INVENTOR(S) : Kenji Kanai

It is certified that error appears in the above-indentified patent and that said Letters Patent is hereby corrected as shown below:

On the cover page of the patent,

[75] Inventor:, please delete "kanji Kanai" and substitute therefor -- Kenji Kanai --.

Signed and Sealed this

Twenty-eight Day of February, 1995

*Attest:*

Bruce Lehman

BRUCE LEHMAN

*Attesting Officer*

*Commissioner of Patents and Trademarks*